US006266494B1

(12) United States Patent
Budnik et al.

(10) Patent No.: US 6,266,494 B1
(45) Date of Patent: Jul. 24, 2001

(54) HIGH-ALTITUDE COMPENSATION FOR A XEROGRAPHIC DEVELOPMENT SYSTEM

(75) Inventors: Roger W. Budnik, Rochester; James M. Pacer, Webster; Scott L. Kauffman; Richard M. Maier, both of Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/669,105

(22) Filed: Sep. 25, 2000

(51) Int. Cl.[7] ..... G03G 15/08
(52) U.S. Cl. ..... 399/55; 399/285
(58) Field of Search ..... 399/55, 252, 266, 399/285, 272, 281, 290

(56) References Cited

U.S. PATENT DOCUMENTS 4,343,010 * 8/1982 Denny et al. ..... 347/228
4,610,531 9/1986 Hayashi et al. ..... 355/14
4,870,460 * 9/1989 Harada et al. ..... 399/49
5,402,214 3/1995 Henderson ..... 355/246
5,621,506 * 4/1997 Hosaka et al. ..... 399/284
5,890,042 3/1999 Wong et al. ..... 399/285

FOREIGN PATENT DOCUMENTS 60-140271 * 7/1985 (JP) .
61-254958 * 11/1986 (JP) .

* cited by examiner

*Primary Examiner*—Quana M. Grainger
(74) *Attorney, Agent, or Firm*—R. Hutter

(57) ABSTRACT

In a xerographic printing apparatus wherein a development field is maintained between the photoreceptor and a donor member, there is always a danger of arcing across the field, particularly at high elevations. An arcing-avoidance system interacts with the print quality control system of a printing apparatus, to monitor the biases within the apparatus being demanded at various times by the control system. If a bias consistent with arcing conditions is approached, the arcing-avoidance system constrains the control system to avoid the arcing conditions. The arcing-avoidance system accepts as an input the elevation of a particular printing apparatus.

9 Claims, 4 Drawing Sheets

HIGH-ALTITUDE COMPENSATION FOR A XEROGRAPHIC DEVELOPMENT SYSTEM

FIELD OF THE INVENTION

This invention relates generally to a development system as used in xerography, and more particularly concerns a "jumping" development system in which toner is conveyed to an electrostatic latent image by an AC field.

BACKGROUND OF THE INVENTION

In a typical electrostatographic printing process, such as xerography, a photoreceptor is charged to a substantially uniform potential so as to sensitize the surface thereof. The charged portion of the photoreceptor is exposed to a light image of an original document being reproduced. Exposure of the charged photoreceptor selectively dissipates the charges thereon in the irradiated areas. This records an electrostatic latent image on the photoreceptor corresponding to the informational areas contained within the original document. After the electrostatic latent image is recorded on the photoreceptor, the latent image is developed by bringing a developer material into contact therewith. Generally, the developer material comprises toner particles adhering triboelectrically to carrier granules. The toner particles are attracted from the carrier granules to the latent image forming a toner powder image on the photoreceptor. The toner powder image is then transferred from the photoreceptor to a copy sheet. The toner particles are heated to permanently affix the powder image to the copy sheet. After each transfer process, the toner remaining on the photoconductor is cleaned by a cleaning device.

One specific type of development apparatus currently used in high-quality xerography is known as a hybrid jumping development (HJD) system. In the HJD system, a layer of toner is laid down evenly on the surface of a "donor roll" which is disposed near the surface of the photoreceptor. Biases placed on the donor roll create two development fields, or potentials, across the gap between the donor roll and the photoreceptor. The action of these fields causes toner particles on the donor roll surface to form a "toner cloud" in the gap, and the toner in this cloud thus becomes available to attach to appropriately-charged image areas on the photoreceptor.

In any xerographic development system in which there is a substantial potential relative to the photoreceptor, but particularly when there exists an alternating current field across a development gap, there is a practical risk of arcing across the gap. Such arcing will of course have a deleterious effect on the operation of the printing apparatus, causing at the very least a print defect and at worst damage to the apparatus. The various control systems for maintaining print quality in any xerographic printing apparatus are liable to cause the various potentials associated with the xerographic process to reach such levels that arcing is possible. The risk of arcing is particularly increased in situations where the printing apparatus is installed at high altitudes, such as in mountainous regions. The relatively low air pressure in at higher altitudes can lead to Paschen breakdown, that is, the ionization of air molecules which leads to arcing, at much lower potentials than would occur at lower altitudes.

The present invention is directed toward a system in which conditions conducive to arcing are detected, and the control systems over the xerographic process are, if necessary, modified to avoid these conditions.

DESCRIPTION OF THE PRIOR ART

U.S. Pat. No. 4,610,531 discloses the basic concept of jumping development with an AC field set up between a donor member and a photoreceptor.

U.S. Pat. No. 5,402,214 discloses a control system for a xerographic printing system in which the reflectivity of a test patch is measured, and the DC bias of a field associated with the development unit is adjusted accordingly.

U.S. Pat. No. 5,890,042 discloses a hybrid jumping development system, in which a donor roll is loaded with a layer of toner particles by a magnetic roll which conveys toner which adheres to carrier granules.

SUMMARY OF THE INVENTION

In accordance with the present invention, there is provided, in an electrostatographic development system wherein toner is conveyed from a donor member over a development gap to a charge receptor by an AC development field in the development gap, a method comprising the step of monitoring at least a first parameter of the system to detect an arcing condition within the development gap.

DETAILED DESCRIPTION OF THE INVENTION

Figure 1:
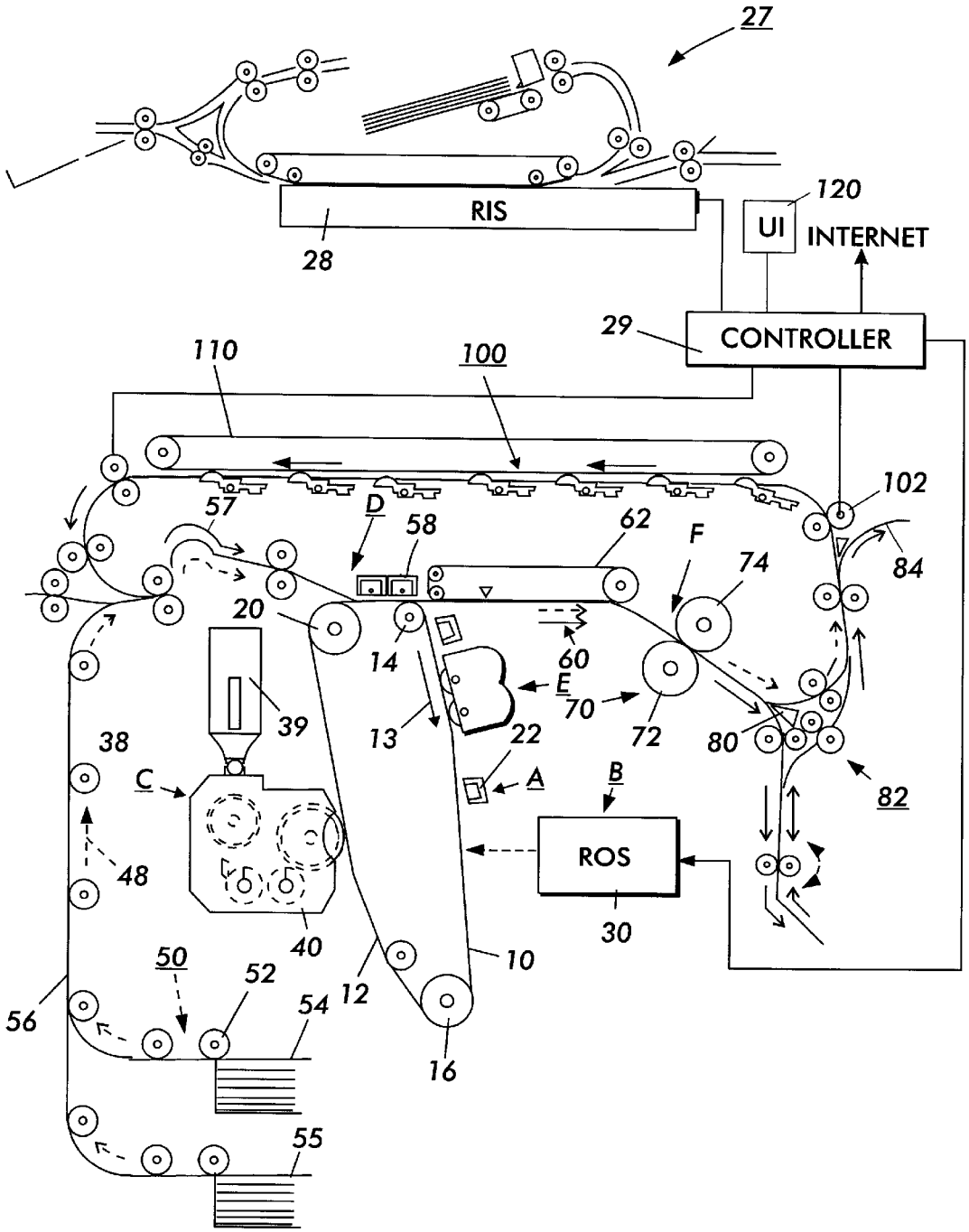
FIG. 1 PRIOR ART
FIG. 1 is a schematic elevational view of a typical electrophotographic printing machine utilizing the toner maintenance system therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the development system of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a photosensor array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoreceptor belt 10. Preferably, the photoreceptor belt 10 is made from a photoconductive material, forming a photoconductive surface 12, coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roll 14, tensioning roll 16 and drive roll 20. As roll 20 rotates, it advances belt 10 in the direction of arrow 13.

Initially, a portion of the photoconductive surface passes through charging station A. At charging station A, a corona generating device, or corotron, indicated generally by the reference numeral 22, charges the photoreceptor 10 to a relatively high, substantially uniform potential.

At an exposure station B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoreceptor 10 to record an electrostatic latent image thereon corresponding to the continuous tone image received from ESS 29. As an alternative, ROS 30 may employ a linear array of light emitting diodes (LEDs) arranged to illuminate the charged portion of photoreceptor 10 on a raster-by-raster basis.

After the electrostatic latent image has been recorded on photoconductive surface 12, photoreceptor 10 advances the latent image to a development station, C, where toner, in the form of liquid or dry particles, is electrostatically attracted to the latent image using the device of the present invention as further described below. The latent image attracts toner particles from the carrier granules forming a toner powder image thereon. As successive electrostatic latent images are developed, toner particles are depleted from the developer material. A toner particle dispenser, indicated generally by the reference numeral 39, on signal from controller 29, dispenses toner particles into developer housing 40 of developer unit 38 based on signals from a toner maintenance sensor (not shown).

With continued reference to FIG. 1, after the electrostatic latent image is developed, the toner powder image present on photoreceptor 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roll 72 and a pressure roll 74 with the powder image on the copy sheet contacting fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed for recirculation back through transfer station D and fuser 70 for receiving and permanently fixing the side two image to the backside of that duplex sheet, before it exits via exit path 84.

After the print sheet is separated from photoconductive surface 12 of photoreceptor 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The control of all of the exemplary systems heretofore described may be accomplished by conventional control switch inputs from the printing machine consoles selected by the operator.

Figure 2:
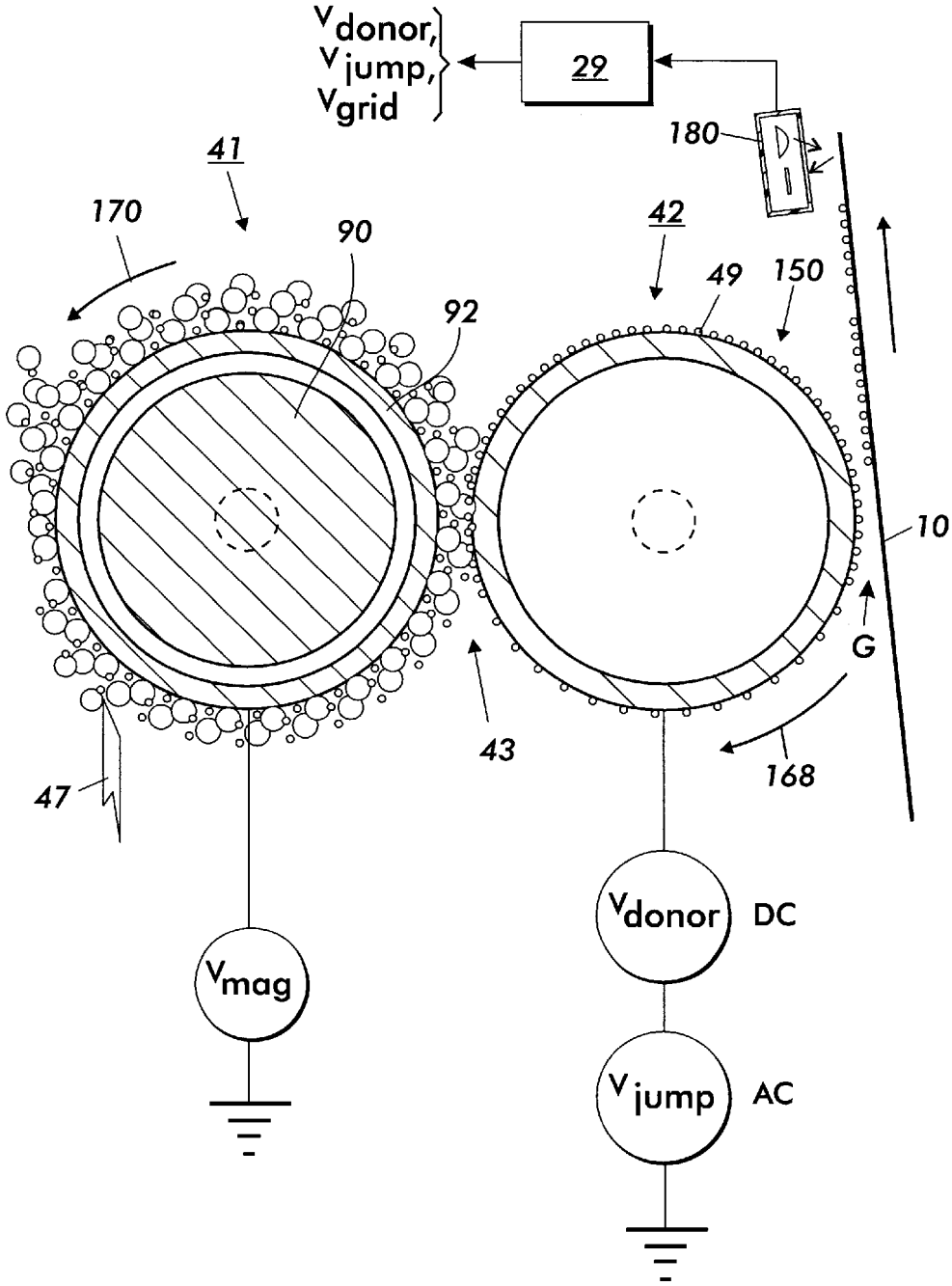
FIG. 2 is a schematic elevational view of the development system utilizing the invention herein.

Turning now to FIG. 2, there is shown development system 38 in greater detail. More specifically, a hybrid development system is shown where toner is loaded onto a donor roll from a second roll, e.g. a magnetic brush roll. The toner is developed onto the photoreceptor from the donor roll using the hybrid jumping development system (HJD) described below. As shown thereat, development system 38 includes a housing 40 defining a chamber for storing a supply of developer material therein. Donor roll 42 and magnetic roll 41 are mounted in chamber of housing 40. The donor roll 42 can be rotated in either the 'with' or 'against' direction relative to the direction of motion of the photoreceptor 10.

In FIG. 2, donor roll 42 is shown rotating in the direction of arrow 168, i.e. the against direction. Similarly, the magnetic roll 41 can be rotated in either the 'with' or 'against' direction relative to the direction of motion of donor roll 42. In FIG. 2, magnetic roll 41 is shown rotating in the direction of arrow 170 i.e. the with direction. Donor roll 42 is preferably made from a conductive core which may be a metallic material with a semi-conductive coating such as a phenolic resin or ceramic.

Magnetic roll 41 meters a constant quantity of toner having a substantially constant charge onto donor roll 42. This ensures that the donor roll provides a constant amount of toner having a substantially constant charge as maintained by the present invention in the development gap. Metering blade 47 is positioned closely adjacent to magnetic roll 41 to maintain the compressed pile height of the developer material on magnetic roll 41 at the desired level. Magnetic roll 41 includes a non-magnetic tubular member 92 made preferably from aluminum and having the exterior circumferential surface thereof roughened. An elongated magnet 90 is positioned interiorly of and spaced from the tubular member. The magnet is mounted stationarily. The tubular member rotates in the direction of arrow 170 to advance the developer material adhering thereto into the nip 43 defined by donor roll 42 and magnetic roll 41. Toner particles are attracted from the carrier granules on the magnetic roll to the donor roll.

Further as shown in FIG. 2, the magnetic roll 41 and the donor roll 42 are respectively biased in order to convey toner particles from a magnetic roll 41 to donor roll 42, and then across the gap, indicated as 200, between of the donor roll 42 and it the surface of photoreceptor 10. With regard to magnetic roll 41, the bias on the roll is indicated as Vmag, which is a simple DC bias. Donor roll 42 is, in turn, biased with both a DC bias, indicated as Vdonor, and a superimposed AC bias, indicated as Vjump. (The photoreceptor 10 is typically connected to ground, such as through a backer bar, not shown, in contact therewith.) The AC on the donor roll 42 ultimately causes the toner layer on the donor roll 42 to form a "cloud" of toner near the gap between the donor roll 42 and the photoreceptor 10: in this way, the free toner particles in the cloud can attach to appropriately-charged image areas on the photoreceptor 10.

Figure 3:
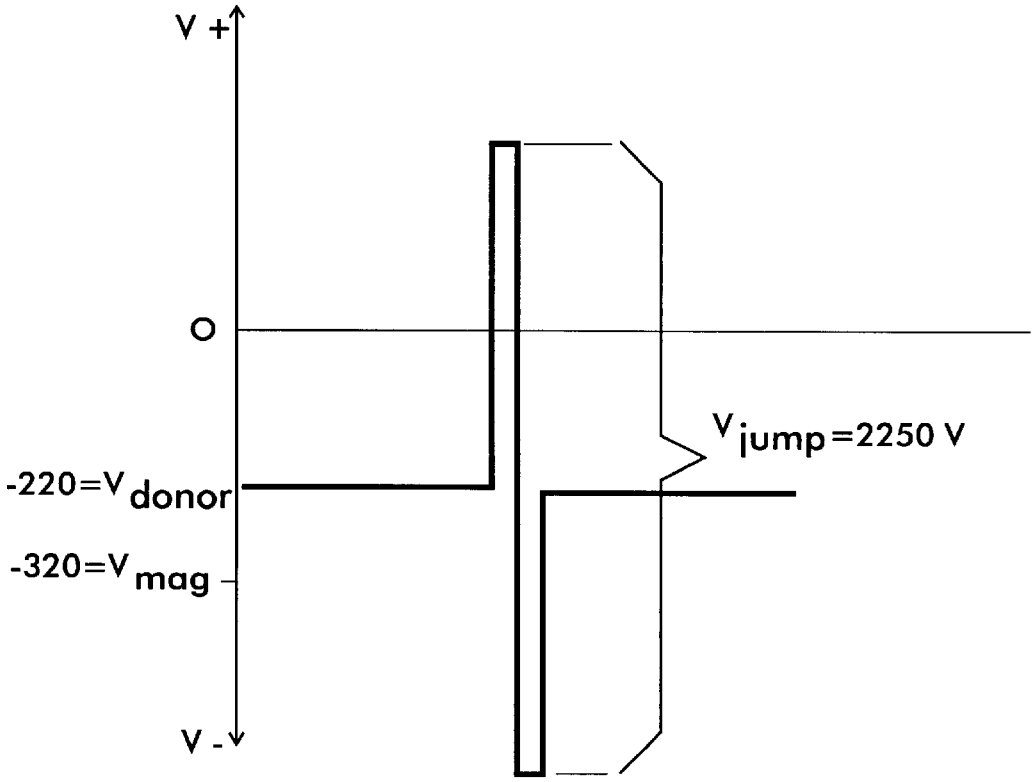
FIG. 3 is a diagram showing the biases of various elements in a development system.

FIG. 3 is a diagram showing the relative biases on magnetic roll 41 and donor roll 42 for a typical practical embodiment of a xerographic printer. This practical embodiment will further be discussed with specific reference to the claimed invention, but of course the basic principles shown and claimed herein will apply to any applicable machine design. In this embodiment, for normal operation, the DC bias on the donor roll 42, Vdonor, is −220 VDC. Riding on this DC bias on the donor roll 42 is an AC square wave with an amplitude (top to bottom), Vjump, of 2250V: clearly, a portion of the total bias on donor roll 42 will enter positive polarity, as shown. (A typical frequency of the square wave is about 3.25 kHz.) Magnetic roll 41, under normal conditions, is biased to −113 VDC, shown as Vmag.

With the particular design of a development system such as shown in FIG. 2, a high risk location for arcing is the gap G between donor roll 42 and the surface of photoreceptor 10. Clearly, the biases Vdonor and Vjump on donor roll 42 will directly affect whether dangerous arcing conditions exist in the gap at any particular time. The function of densitometer 180, influencing control system 29, which in turn controls, among other parameters, Vdonor and Vjump, can cause the general control system, designed to optimize overall print quality, to lead to possible arcing conditions in the course of operation of the printing machine.

In order to determine whether possible arcing conditions exist in gap G, the relevant equations for field strength E for both solid (i.e., printed small areas) and background (undeveloped or white small areas) portions of an image are as follows:

$$Esolid = \frac{(Vjump/2 + Vdonor) - Vimg}{gap}$$

$$Ebkg = \frac{(Vjump/2 - Vdonor) - Vddp}{gap}$$

Where:

Vjump is the amplitude (top to bottom) of the AC potential on the donor roll 42; Vdonor is the DC bias on donor roll 42; Vgrid (explained below) is the potential on the corotron 22, which places the initial charge on photoreceptor 10; gap is the width of the gap between the donor roll 42 and photoreceptor 10; Vimg is the local potential for a small area on the photoreceptor which is intended to be developed with toner (i.e., a "solid area"); and Vddp ("dark decay potential") is the local potential for a small area on the photoreceptor which is intended to remain white in the printed image (i.e., a "background area"). Vddp can be reasonably estimated as Vddp=Vgrid+60 (or some other constant determined from real world voltage measurements of a particular printer design). Similarly, Vimg can be reasonably estimated from off-line tests of a particular printer design.

(Graphic representations of some of the above parameters can be seen in FIG. 3.)

It will be noted, in the above equations, that of the various variables, only Vjump, Vdonor, and Vgrid are readily adjustable in the course of operation of a machine, the other variables being substantially constant while the machine is running. Therefore, in order to avoid arcing conditions, the values of Esolid and Ebkg must be constrained so as not to exceed arcing conditions, and the only practical way to constrain these values is to monitor and control at least one of Vdonor, Vjump, and Vgrid while the machine is in operation.

Another important parameter affecting whether arcing conditions exist in a particular situation is the ambient air pressure, which in turn generally relates to the elevation of a particular machine relative to sea level. Once again, in general, the higher the elevation of a particular machine, the higher the likelihood of arcing conditions. Thus, according to one aspect of the present invention, a key input parameter to a control system is a number symbolic of the elevation of the particular machine. There are many possible ways in which this number can be entered into a control system. One option is to include a barometer or altimeter as part of the machine itself, but this would add expense. It is simpler to have service personnel enter the number relating to the elevation when the machine is installed. The nature of this number can depend on the sophistication of the system. The service personnel could enter the more or less precise elevation of the installation site, or more simply could just enter, via a control panel, a yes-or-no indication that the elevation is above a certain threshold level, such as over 4000 feet.

Figure 4:
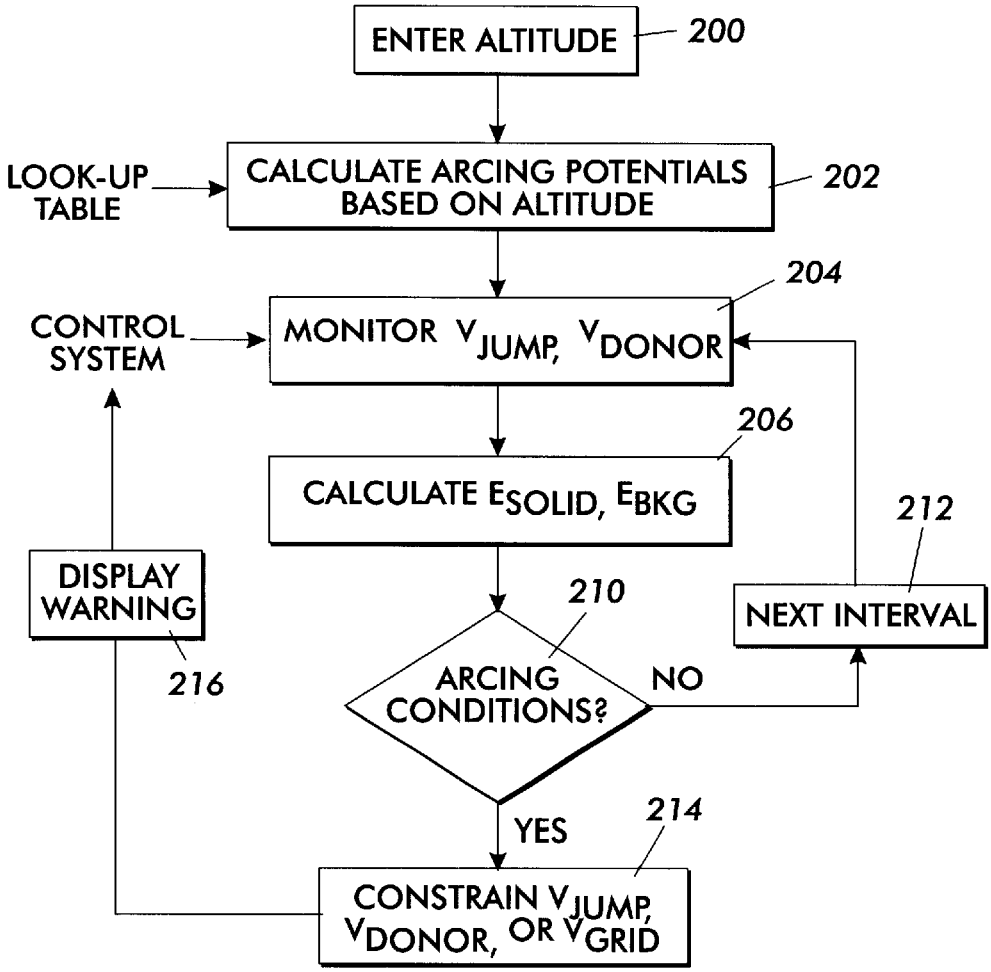
FIG. 4 is a flowchart illustrating the arcing-control aspect of a control system for a xerographic printer according to the present invention.

FIG. 4 is a flowchart illustrating the arcing-control aspect of a control system for a xerographic printer according to the present invention. It should be understood that what is shown in the Figure is only a part of a general control method for maintaining print quality. As such, the arcing-avoidance steps shown in the Figure can be considered as "riding on" the more general control system (not shown) by which overall desired print quality is achieved. A control system with the single desired state of optimal print quality, such as determined by readings from a densitometer monitoring the developed images on photoreceptor 10, will at various times require that different elements, such as donor roll 42 or corotron 22, have particular biases. In the course of operation of the general control system, certain biases on various elements may be demanded for the sake of print quality, and these new biases may accidentally result in arcing conditions in the development gap G. It is the general function of the present invention, and in particular the steps shown in the Figure, to detect conditions in which arcing is likely to occur, and then alter the function of the general control system to avoid these arcing conditions.

With particular reference to FIG. 4, at some initial time, such as at installation of the machine at a site, an altitude is entered into the system, such as shown at step 200. Once again, this altitude may be determined by an instrument associated with the machine, or entered by service personnel. The next step, shown as 202, is to convert this altitude to an associated arcing potential. In other words, there is a known empirical relationship between the elevation and the Paschen breakdown voltage. This empirical relationship can be summarized, either precisely or roughly, by a look up table which can readily be incorporated into the machine itself. In one practical embodiment of the present invention, the function describing this empirical relationship is set at a constant 155 volts/mil gap width for any altitude from sea level to 4,000 ft., with a function sloping linearly from 155 volts/mil at 4,000 ft. to 120 volts/mil at 10,000 ft. In this way, arcing conditions for a particular altitude can be looked up. It is a matter of design choice, how close to the calculated breakdown voltage the potential in a gap G will be allowed to approach. For instance, if the breakdown voltage is determined to be 155 volts/mil, a risk-averse system could be contemplated which would trigger a warning at 100 volts/mil, while in some situations 145 volts/mil would be considered acceptably far from arcing conditions. Various threshold determination arrangements will be apparent.

Once the altitude-dependent arcing conditions are determined, the field strength of the development gap G is monitored while the printing machine is running, which also means while the general control system for optimizing print quality is running. According to the present invention, on a reasonably regular basis, such as at the start of every new job, or after an interval of a predetermined number of prints, the values of Vjump and Vdonor which are at the moment being demanded by the control system (step 204) are entered into the equations described above, to determine a running value of the field strength in the gap for both solid and background areas, Esolid and Ebkg (step 206). At step 208, these running determinations of Esolid and Ebkg are compared to the altitude dependent breakdown voltage to determine whether arcing conditions are being dangerously approached (step 210). If arcing conditions are not being approached, the system simply waits for the next interval, such as the next job over the next count of a certain number of prints, to monitor Vjump and Vdonor yet again (step 212).

If, however, the current values of either Esolid and Ebkg approach a predetermined threshold level near the breakdown voltage in which arcing conditions would result, the system shown in FIG. 4 is called upon to override the general control system to avoid this dangerous condition, in particular by causing the control system to constrain, either by an upper or lower bound, at least one of the parameters which can be used to control the potential in development gap G. In the particular embodiment, either Vjump, Vdonor, or Vgrid can be constrained (step 214). Of course, it is highly dependent on the overall nature of the control system for obtaining optimal print quality which of these parameters is most easily constrained to avoid arcing conditions while still maintaining desirable print quality. If it is apparent that print quality will suffer regardless of which parameter is constrained, it may be desirable to provide a system in which the printing apparatus is stopped and an error message is communicated to the user, such as to the user interface shown as 120 in FIG. 1 and/or over the internet (such as to service personnel). Alternately, in a design of a xerographic development system in which a secondary supply of toner-rich developer can be dispensed into the development unit automatically (such as, in the embodiment of FIG. 1, dispensing developer or pure toner from dispenser 39 into developer housing 40), it is possible to initiate a dispense of new developer as a way of bringing the various biases into acceptable ranges.

What is claimed is:

1. An electrostatographic printing apparatus having a development system, the development system comprising:

a donor member;

a charge receptor, a development gap being defined between the donor member and the charge receptor;

means for creating a development field in the development gap, whereby toner is conveyed from the donor member over the development gap to the charge receptor by the development field;

means for monitoring at least a first parameter of the system to detect an arcing condition within the development gap;

means for creating at least one of a DC bias and an AC bias in the development field;

means for creating an initial charging voltage on the charge receptor; and means for altering a second parameter of the system to avoid the arcing condition if an arcing condition is detected, wherein the second parameter is the initial charging voltage on the charge receptor.

2. The apparatus of claim 1, wherein the monitoring means operates on a regular basis when the system is operating.

3. The apparatus of claim 1, further comprising means for communicating that an arcing condition is detected.

4. An electrostatographic printing apparatus having a development system, the development system comprising:

a donor member;

a charge receptor, a development gap being defined between the donor member and the charge receptor;

means for creating a development field in the development gap, whereby toner is conveyed from the donor member over the development gap to the charge receptor by the development field;

means for monitoring at least a first parameter of the system to detect an arcing condition within the development gap;

a primary developer supply, the primary developer supply providing toner to be conveyed across the development gap;

a secondary developer supply;

means for selectably transferring toner from the secondary developer supply to the primary developer supply; and means for altering a second parameter of the system to avoid the arcing condition if an arcing condition is detected, wherein the second parameter relates to deciding to transfer toner from the secondary developer supply to the primary developer supply.

5. The apparatus of claim 4, wherein the monitoring means operates on a regular basis when the system is operating.

6. The apparatus of claim 4, further comprising means for communicating that an arcing condition is detected.

7. An electrostatographic printing apparatus having a development system, the development system comprising:

a donor member;

a charge receptor, a development gap being defined between the donor member and the charge receptor;

means for creating a development field in the development gap, whereby toner is conveyed from the donor member over the development gap to the charge receptor by the development field;

means for monitoring at least a first parameter of the system to detect an arcing condition within the development gap; and means for calculating a field strength of the development field, based on at least one parameter from a group consisting of an amplitude of an AC bias in the development field, a magnitude of a DC bias in the development field, and a number symbolic of a width of the development gap, the calculating means being adapted to calculate at least one local field strength in the development gap, the local field strength being associated with one of a solid image area on the charge receptor and a background image area on the charge receptor.

8. The apparatus of claim 7, wherein the monitoring means operates on a regular basis when the system is operating.

9. The apparatus of claim 7, further comprising means for communicating that an arcing condition is detected.

* * * * *